US008433086B2

(12) United States Patent
Heuermann et al.

(10) Patent No.: US 8,433,086 B2
(45) Date of Patent: Apr. 30, 2013

(54) HEARING APPARATUS WITH PASSIVE INPUT LEVEL-DEPENDENT NOISE REDUCTION

(75) Inventors: Heike Heuermann, Hamburg (DE); Sebastian Pape, Erlangen (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 1084 days.

(21) Appl. No.: 12/215,372

(22) Filed: Jun. 26, 2008

(65) Prior Publication Data

US 2009/0003627 A1 Jan. 1, 2009

(30) Foreign Application Priority Data

Jun. 29, 2007 (DE) ..... 10 2007 030 067

(51) Int. Cl.
*H04R 25/00* (2006.01)

(52) U.S. Cl.
USPC ..... 381/317; 381/316; 381/321

(58) Field of Classification Search ..... 320/165; 381/331, 312–321; 360/33.1, 65; 358/36
See application file for complete search history.

(56) References Cited

U.S. PATENT DOCUMENTS

| | | | | |
|---|---|---|---|---|
| 4,597,021 | A * | 6/1986 | Yamamitsu et al. | 386/269 |
| 5,225,898 | A * | 7/1993 | Imai et al. | 348/624 |
| 5,903,655 | A * | 5/1999 | Salmi et al. | 381/321 |
| 5,926,334 | A * | 7/1999 | Suzuki | 360/55 |
| 6,628,794 | B1 * | 9/2003 | Dickel et al. | 381/316 |
| 7,016,507 | B1 | 3/2006 | Brennan | |
| 7,826,799 | B2 * | 11/2010 | Kolano et al. | 455/67.14 |
| 8,041,054 | B2 * | 10/2011 | Yeldener et al. | 381/92 |
| 2001/0002100 | A1 * | 5/2001 | Compton et al. | 320/165 |
| 2004/0052392 | A1 * | 3/2004 | Sacha et al. | 381/331 |
| 2004/0175011 | A1 * | 9/2004 | Schaub | 381/316 |
| 2004/0252852 | A1 | 12/2004 | Taenzer | |

FOREIGN PATENT DOCUMENTS

| | | | |
|---|---|---|---|
| EP | 1326479 | A2 | 7/2003 |
| WO | WO 00/01198 | A1 | 1/2000 |

OTHER PUBLICATIONS

King Chung, "Effective compression and noise reduction configurations for hearing protectors", Acoustical Society of America, Feb. 2007, pp. 1-12, vol. 121, No. 2, XP 12096393A.

* cited by examiner

*Primary Examiner* — Eugene Lee
*Assistant Examiner* — Fang-Xing Jiang

(57) ABSTRACT

A hearing apparatus and in particular a hearing device is to be provided, in which interference noises are to be reduced however as natural an acoustic image as possible is consequently retained. To this end, a hearing apparatus with a first signal processing channel, into which a noise reduction device is integrated and a second signal processing channel, which has the same input as the first signal processing channel and into which no noise reduction device, but instead a level limitation device is integrated, is proposed. An adding device adds the output signals of both signal processing channels to form an overall output signal. A passive input level-dependent noise reduction can thus be realized, with which quiet signals can be heard again despite the noise reduction.

7 Claims, 1 Drawing Sheet

HEARING APPARATUS WITH PASSIVE INPUT LEVEL-DEPENDENT NOISE REDUCTION

CROSS REFERENCE TO RELATED APPLICATIONS

This application claims priority of German application No. 10 2007 030 067.2 filed Jun. 29, 2007, which is incorporated by reference herein in its entirety.

FIELD OF THE INVENTION

The present invention relates to a hearing apparatus with a signal processing channel, into which a noise reduction device is integrated. Furthermore, the present invention also relates to a method for reducing interference noises in hearing apparatuses of this type. The term hearing apparatus is understood here to mean a device that can be worn on the ear, in particular a hearing device, a headset, a set of ear phones and the like.

BACKGROUND OF THE INVENTION

Hearing devices are wearable hearing apparatuses which are used to assist the hard-of-hearing. In order to accommodate numerous individual requirements, various types of hearing devices are available such as behind-the-ear (BTE) hearing devices and in-the-ear (ITE) hearing devices, for example also concha hearing devices or completely-in-the-canal (ITE, CIC) hearing devices. The hearing devices listed as examples are worn on the outer ear or in the auditory canal. Bone conduction hearing aids, implantable or vibrotactile hearing aids are also available on the market. The damaged hearing is thus stimulated either mechanically or electrically.

The key components of hearing devices are principally an input converter, an amplifier and an output converter. The input converter is normally a receiving transducer e.g. a microphone and/or an electromagnetic receiver, e.g. an induction coil. The output converter is most frequently realized as an electroacoustic converter e.g. a miniature loudspeaker, or as an electromechanical converter e.g. a bone conduction hearing aid. The amplifier is usually integrated into a signal processing unit. This basic configuration is illustrated in FIG. 1 using the example of a behind-the-ear hearing device. One or a plurality of microphones 2 for recording ambient sound are built into a hearing device housing 1 to be worn behind the ear. A signal processing unit 3 which is also integrated into the hearing device housing 1 processes and amplifies the microphone signals. The output signal for the signal processing unit 3 is transmitted to a loudspeaker or receiver 4, which outputs an acoustic signal. Sound is transmitted through a sound tube, which is affixed in the auditory canal by means of an otoplastic, to the device wearer's eardrum. Power for the hearing device and in particular for the signal processing unit 3 is supplied by means of a battery 5 which is also integrated in the hearing device housing 1.

Noise reduction algorithms are used to suppress interfering noises and/or to reduce them in terms of their level. In particular, very quiet noises are then often lowered to completely below the threshold of hearing. This results in an unnatural auditory impression. However, it is desirable for a natural auditory impression for quiet noises also not to get completely lost, i.e. not lowered to below the threshold of hearing.

In order to solve this problem, the possibility exists of deactivating the noise reduction in the case of quiet ambient levels. The manual deactivation of the noise reduction would be very impractical. With automatic deactivation, the problem nevertheless exists of determining the threshold at which the noise reduction is to be deactivated. In addition, a very unstable acoustic pattern results in the case of levels precisely around this threshold.

The publication EP 1 307 072 A2 discloses a method for operating a hearing device, in which interfering acoustic effects caused by activation and deactivation processes are to be avoided. The activation and deactivation of algorithms, which refer to the reduction of interference signals, is also referred to here in particular.

SUMMARY OF THE INVENTION

The object of the present invention thus consists in proposing a hearing apparatus, in which noise reduction takes place, but nevertheless as natural an acoustic pattern as possible is retained. Furthermore, a corresponding method for reducing interference noises in hearing apparatuses is to be provided.

This object is achieved in accordance with the invention by a hearing apparatus having a first signal processing channel, into which a noise reduction device is integrated, including a second signal processing channel, which has the same input as the first signal processing channel and into which no noise reduction device is integrated but instead a level limitation device and an adding device, with which the output signals of both signal processing channels can be added to form an overall output signal.

Provision is further made in accordance with the invention for a method for reducing interference noises in hearing apparatuses by processing an input signal in a first signal processing channel including noise reduction, processing the input signal in a second signal processing channel without noise reduction but with level limitation and adding the output signals of the two signal processing channels to form an overall output signal.

The two-channel processing advantageously renders it possible for the noise reduction to take place passively as a function of the input level. Very quiet noises are then also not lowered to below the threshold of hearing and thus do not get lost.

The two signal processing channels are preferably realized on one single chip. In this way, a reliable signal processing is enabled, for the implementation of which only very little installation space is needed.

Each of the two signal processing channels can be subdivided into several frequency channels. As a result, the level limitation and the noise reduction can be configured in a frequency-dependent manner.

According to a special embodiment, the level limitation device has an increasing compression characteristic curve in the overall activity region. The natural auditory impression can thus be retained even more effectively, since louder noises are always presented louder than quiet noises.

BRIEF DESCRIPTION OF THE DRAWINGS

The present invention is described in more detail with reference to the appended drawings, in which.

DETAILED DESCRIPTION OF THE INVENTION

The exemplary embodiment illustrated in more detail below represents a preferred embodiment of the present invention.

Figure 1:
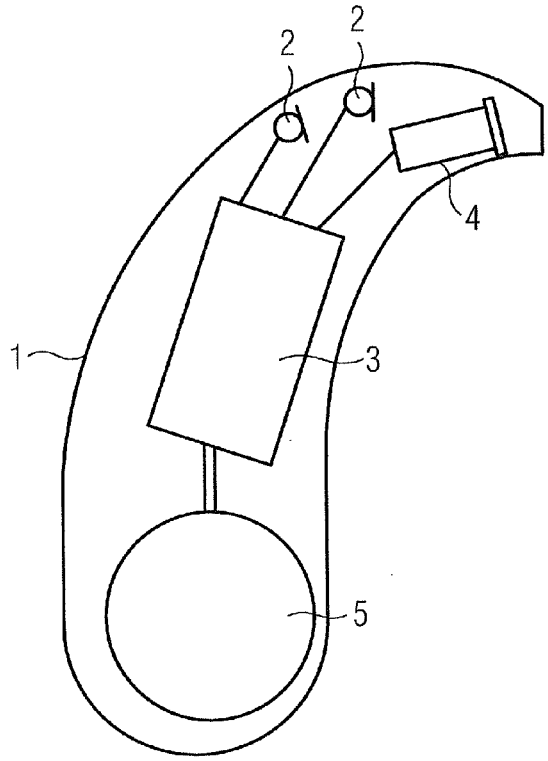
FIG 1 (Prior art)
FIG. 1 shows the basic design of a hearing device with its essential components according to the prior art and FIG. 2 shows a block diagram of the signal processing unit of a hearing apparatus according to the invention.
Figure 2:
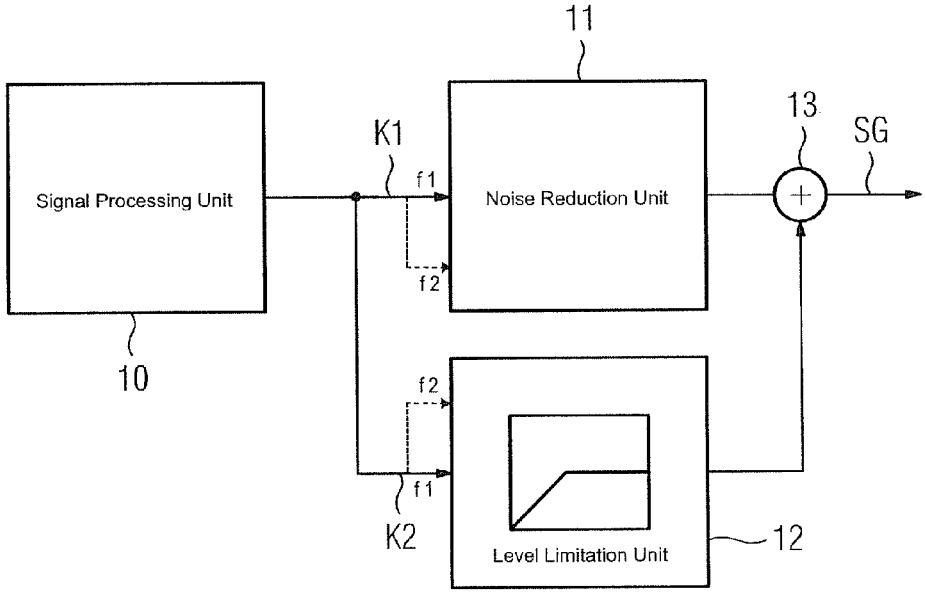

FIG. 2 shows a symbolic representation of the design of a signal processing unit of an inventive hearing apparatus. The signal of a processing unit 10 is supplied to a noise reduction unit 11 in a first channel K1 for interference noise reduction purposes. In parallel to this, the output signal of the signal processing unit 10 is supplied to a level limiter 12 in a second channel K2. This limits the output level to a predetermined degree. In the example in FIG. 2, the level limiter 12 is provided with a characteristic curve, with which high levels are limited to a fixed maximum level, but it is likewise possible for the characteristic curve to increase marginally following the break, as a result of which a hard limitation is not realized but instead a certain compression. A compression of this type is to be understood here under the term "level limitation".

The output signals of the channels K1 and K2 are added in an adder 13 to form an overall output signal SG.

The signal of the signal processing unit 10 is thus divided into two channels K1 and K2 prior to the noise reduction. A noise reduction with the noise reduction unit 11 usually takes place in the first channel K1. No noise reduction takes place in the second channel K2. The signal is limited and compressed here to a defined very low output level by the level limiter 12 only in the dynamics. Finally, the noise-reduced signal and the level-limited signal are added again. This means that a noise signal with at least a reduced level is contained in the output signal SG in all instances. Quiet noises up to the characteristic curve inflection point of the level limiter 12 are even absorbed in the output signal SG unattenuated.

The processing illustrated in FIG. 2 can be implemented in parallel in several frequency channels. High-frequency and low-frequency noises and/or noise portions can be individually attenuated in this way depending on user requirements.

According to the inventive idea, the noise reduction is thus partially handled using a level-limited channel. A passive input level-dependent noise reduction can thus be realized, since noises with a very low level are hardly reduced, whereas noises with a high level are correspondingly reduced. It is thus possible for quiet signals to be able to be heard again despite the noise reduction. Furthermore, it does not require an active level-dependent control with a decision threshold, since the noise reduction takes place passively in the two channels. The fact that no active control with a decision threshold is necessary results in a further advantage of a completely quiet, natural acoustic pattern. The receiver thus has the chance of acclimatizing itself to quiet noises, and blanking them out in the perception like people with normal hearing. This effect does not occur in the case of threshold value-controlled algorithms, since the quiet noises are not continuously present.

The addition of signals from two channels, does not result, as mentioned above, in switching problems and thus in a natural acoustic pattern. With loud signals, the first channel K1 with the noise reduction blends out the second channel K2 without noise reduction. With quiet signals, the second channel K2 can be heard, however the first channel K1 can no longer be heard.

A further advantage of this two-channel processing consists in a more significant noise reduction being possible in some circumstances, which also pushes louder noises below the threshold of hearing in the first channel without having to accept that quieter details disappear as a result (overall in quiet passages). However, in loud environments, the noise reduction takes full effect and the second channel is blended out.

The invention claimed is:

1. A hearing apparatus with noise reduction, comprising:

a signal processing unit that processes an input signal of the hearing apparatus into an output signal, wherein the output signal therefrom is divided into two channels comprising a first signal processing channel having a first signal thereon and a second signal processing channel having a second signal thereon, wherein any noise signal originally contained in the input signal is also contained in the first and second signals;

a noise reduction unit into which the first signal is fed providing interference noise reduction to the first signal resulting in an output signal from the noise reduction unit having reduced noise as compared to the first signal;

a level limitation unit into which the second signal is fed that limits an output level of the second signal to a predetermined degree resulting in an output signal from the level limitation unit having a limited level compared to the second signal;

an adding unit that adds the output signal of the noise reduction unit with the output signal of the level limitation unit to form an overall output signal, such that the noise signal originally contained in the input signal that was also contained in the second signal is still contained in part as a quiet noise in the overall output signal, but has at least a reduced level from the level limitation unit that limits the output level of the second signal; and outputting the overall output signal such that the overall output signal still comprises the quiet noise from the level limitation unit to provide a more natural acoustic pattern.

2. The hearing apparatus as claimed in claim 1, wherein the first and the second signal processing channels are arranged on a single chip.

3. The hearing apparatus as claimed in claim 1, wherein the first and the second signal processing channels are divided into a plurality of frequency channels.

4. The hearing apparatus as claimed in claim 1, wherein the level limitation unit comprises an increasing compression characteristic curve used to implement the level limitation.

5. A method for reducing an interference noise in a hearing apparatus, comprising:

processing an input signal of the hearing apparatus via a signal processing unit into an output signal, wherein the output signal therefrom is divided into two channels comprising a first signal processing channel having a first signal thereon and a second signal processing channel having a second signal thereon, wherein any noise signal originally contained in the input signal is also contained in the first and second signals;

feeding the first signal into a noise reduction unit for reducing the interference noise of the first signal resulting in an output signal from the noise reduction unit having reduced noise as compared to the first signal;

feeding the second signal into a level limitation unit for limiting an output level of the second signal to a predetermined degree resulting in an output signal from the level limitation unit having a limited level compared to the second signal;

adding the output signal of the noise reduction unit with the output signal of the level limitation unit to produce an added signal such that the noise signal originally contained in the input signal that was also contained in the second signal is still contained in part as a quiet noise in the overall output signal, but has at least a reduced level from the level limitation unit that limits the output level of the second signal; and outputting the added signal such that the overall output signal still comprises the quiet noise from the level limitation unit to provide a more natural acoustic pattern.

6. The method as claimed in claim 5, wherein the first and the second signal processing channels are divided into a plurality of frequency channels.

7. The method as claimed in claim 5, wherein the output level of the processed input signal is limited based on an increasing compression characteristic curve used to implement the level limitation.

* * * * *